US011603510B2

(12) United States Patent
Emiru et al.

(10) Patent No.: US 11,603,510 B2
(45) Date of Patent: Mar. 14, 2023

(54) CONCENTRATED SOLID HARD SURFACE CLEANER

(71) Applicant: ECOLAB USA INC., Saint Paul, MN (US)

(72) Inventors: Hilina Emiru, Saint Paul, MN (US); Erik C. Olson, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 119 days.

(21) Appl. No.: 16/811,008

(22) Filed: Mar. 6, 2020

(65) Prior Publication Data

US 2020/0283701 A1 Sep. 10, 2020

Related U.S. Application Data

(60) Provisional application No. 62/814,387, filed on Mar. 6, 2019.

(51) Int. Cl.
*C11D 3/33* (2006.01)
*C11D 1/04* (2006.01)
(Continued)

(52) U.S. Cl.
CPC ..... *C11D 3/33* (2013.01); *C11D 1/04* (2013.01); *C11D 1/14* (2013.01); *C11D 1/143* (2013.01);
(Continued)

(58) Field of Classification Search
CPC .... C11D 1/14; C11D 1/29; C11D 1/75; C11D 1/90; C11D 1/94; C11D 3/10; C11D 3/33; C11D 3/3761
(Continued)

(56) References Cited

U.S. PATENT DOCUMENTS 5,658,867 A 8/1997 Pancheri et al.
5,663,132 A 9/1997 Talley
(Continued)

FOREIGN PATENT DOCUMENTS

CN 105542993 A 5/2016
CN 105969550 A 9/2016
(Continued)

OTHER PUBLICATIONS

International Searching Authority in connection with PCT/US2020/021309 filed Mar. 6, 2020, "The International Search Report and the Written Opinion of the International Searching Authority, or the Declaration", 14 pages, dated Jul. 3, 2020.

*Primary Examiner* — Gregory R Delcotto
(74) *Attorney, Agent, or Firm* — McKee, Voorhees & Sease, PLC

(57) ABSTRACT

A solid hard surface cleaning composition suitable for replacing liquid formulations while providing at least equivalent or enhanced cleaning performance, including at lower concentrations, is provided. The solid hard surface cleaning compositions include alkali metal carbonate alkalinity source(s), aminocarboxylic acid chelant(s), amphoteric surfactant(s), polyacrylate polymer(s) and anionic surfactant(s). The solid hard surface cleaning compositions can include additional functional ingredients, such as corrosion inhibitors. The solid hard surface cleaning compositions do not include hydroxide alkalinity and beneficially provide stable ready-to-use formulations that are safe for contact without the use of personal protective equipment (PPE) and are compatible with soft metals.

12 Claims, 6 Drawing Sheets

(51) Int. Cl.

| | |
|---|---|
| ***C11D 1/14*** | (2006.01) |
| ***C11D 1/34*** | (2006.01) |
| ***C11D 1/75*** | (2006.01) |
| ***C11D 1/90*** | (2006.01) |
| ***C11D 3/00*** | (2006.01) |
| ***C11D 3/08*** | (2006.01) |
| ***C11D 3/10*** | (2006.01) |
| ***C11D 3/20*** | (2006.01) |
| ***C11D 3/37*** | (2006.01) |
| ***C11D 11/00*** | (2006.01) |
| ***C11D 17/00*** | (2006.01) |
| ***C11D 17/06*** | (2006.01) |
| ***C11D 1/29*** | (2006.01) |
| ***C11D 1/94*** | (2006.01) |

(52) U.S. Cl.
CPC ..... *C11D 1/29* (2013.01); *C11D 1/345* (2013.01); *C11D 1/75* (2013.01); *C11D 1/90* (2013.01); *C11D 1/94* (2013.01); *C11D 3/0073* (2013.01); *C11D 3/08* (2013.01); *C11D 3/10* (2013.01); *C11D 3/2082* (2013.01); *C11D 3/3761* (2013.01); *C11D 11/0029* (2013.01); *C11D 17/0073* (2013.01); *C11D 17/06* (2013.01)

(58) Field of Classification Search
USPC ..... 510/220, 229, 230, 426, 427, 433, 477, 510/499, 503, 509
See application file for complete search history.

(56) References Cited

U.S. PATENT DOCUMENTS

| | | | | |
|---|---|---|---|---|
| 5,731,279 | A | 3/1998 | Pancheri | |
| 6,455,484 | B1 | 9/2002 | Gladfelter et al. | |
| 6,498,134 | B1 | 12/2002 | Scheibel et al. | |
| 6,506,717 | B1 | 1/2003 | Kott et al. | |
| 6,673,765 | B1 | 1/2004 | Schulz et al. | |
| 6,774,099 | B1 | 8/2004 | Scheibel et al. | |
| 7,893,012 | B2 | 2/2011 | Tjelta et al. | |
| 8,138,135 | B2 | 3/2012 | Moore et al. | |
| 2003/0100464 | A1 | 5/2003 | Kott et al. | |
| 2004/0157760 | A1 | 8/2004 | Man et al. | |
| 2013/0123164 | A1 | 5/2013 | Jones et al. | |
| 2013/0139856 | A1* | 6/2013 | Vinson | B08B 3/044 134/34 |
| 2015/0132833 | A1* | 5/2015 | Chan | C11D 3/38609 510/392 |
| 2015/0315518 | A1 | 11/2015 | Walls et al. | |
| 2016/0145547 | A1 | 5/2016 | Michaels et al. | |
| 2016/0282668 | A1* | 9/2016 | Kang | G02F 1/133514 |
| 2018/0312787 | A1* | 11/2018 | Gelderman | C11D 17/0065 |
| 2019/0390143 | A1* | 12/2019 | Hammel | C11D 7/06 |

FOREIGN PATENT DOCUMENTS

| | | | |
|---|---|---|---|
| CN | 106190637 | A | 12/2016 |
| EP | 1007615 | B1 | 6/2000 |
| EP | 3153570 | B1 | 4/2017 |
| WO | 2010061239 | A1 | 6/2010 |
| WO | 2013085914 | A1 | 6/2013 |
| WO | 2014121406 | A1 | 8/2014 |
| WO | 2016036555 | A1 | 3/2016 |

* cited by examiner

CONCENTRATED SOLID HARD SURFACE CLEANER

CROSS-REFERENCE TO RELATED APPLICATIONS

This application claims priority under 35 U.S.C. § 119 to provisional application Ser. No. 62/814,387, filed Mar. 6, 2019, titled Solid Hard Surface Cleaner, herein incorporated by reference in its entirety.

FIELD OF THE INVENTION

The invention relates to solid hard surface cleaning compositions that do not include hydroxide alkalinity and beneficially provide stable ready-to-use formulations that are safe for contact without the use of personal protective equipment (PPE) and are compatible with soft metals. In particular, the solid hard surface cleaning compositions are suitable for replacing liquid formulations while providing at least equivalent or enhanced cleaning performance. The solid hard surface cleaning compositions include alkali metal carbonate alkalinity source(s), aminocarboxylic acid chelant(s), amphoteric surfactant(s), polyacrylate polymer (s) and anionic surfactant(s). The solid hard surface cleaning compositions can include additional functional ingredients, such as corrosion inhibitors.

BACKGROUND OF THE INVENTION

Various liquid detergents and cleaning products are commercially-available and known in the art. The formulation of alkaline liquid detergents requires both cleaning performance (i.e. removing dirt and soils) and maintaining stable emulsions, suspension and/or solutions for the liquid product. There can be various challenges in transporting and storing liquid cleaning products. Therefore, it can be desirable to replace liquid formulations with solid cleaning compositions. However, providing solid formulations that have both shelf-stability and provide liquid use compositions that are also stable for extended periods of time can be difficult to provide, while maintaining (or exceeding) cleaning performance. Moreover, providing concentrated liquid use compositions can be difficult as solids can be highly concentrated, whereas liquids are inherently limited in concentration by solubility.

Accordingly, it is an objective of the compositions to provide cleaning compositions that provide a higher concentration of surfactants and/or alkalinity in comparison to a liquid concentrated cleaning composition as a result of overcoming such solubility limitations.

It is a further objective of the claimed invention to develop solid hard surface cleaning compositions that provide at least equivalent cleaning performance, or superior cleaning performance, to liquid compositions.

A further object of the invention is to provide stable hard surface cleaning compositions that are also stable ready-to-use formulations.

A further object of the invention is to provide solid hard surface cleaning compositions that do not include hydroxide alkalinity and that are safe for contact without the use of personal protective equipment (PPE) and are compatible with soft metals.

Other objects, advantages and features of the present invention will become apparent from the following specification taken in conjunction with the accompanying figures.

BRIEF SUMMARY OF THE INVENTION

An advantage of the invention is a solid hard surface cleaning composition that provides stable solutions that do not require PPE. A further advantage is a cleaning composition that provides enhanced cleaning efficacy using alkali metal carbonate alkalinity-based compositions that are also safe for use on soft metals.

In an embodiment, solid hard surface cleaning compositions are provided comprising an alkali metal carbonate alkalinity source; at least one chelant comprising an aminocarboxylic acid, a polycarboxylic acid, an aminophosphonate or combination thereof; an amphoteric surfactant; and an anionic surfactant; wherein the composition does not include hydroxide alkalinity sources, and wherein the liquid use composition has a pH of less than about 11 and is a stable liquid for up to about 6 months at room temperature.

In a further embodiment, stable use compositions from solid compositions are provided and do not require PPE, the compositions comprising, consisting essentially of or consisting of: an alkali metal carbonate alkalinity source; at least two chelants comprising an aminocarboxylic acid and polycarboxylic acid; an amine oxide amphoteric surfactant; a sulfate or sulfonate anionic surfactant; and a corrosion inhibitor comprising an alkali metal silicate and/or alkali metal metasilicate; wherein the composition does not include hydroxide alkalinity sources, and wherein the liquid use composition has a pH of less than about 11 and is a stable liquid for up to about 6 months at room temperature.

In a still further embodiment, applications of using the solid hard surface cleaning compositions are provided comprising providing the cleaning composition, either a solid or use composition in aqueous form to a hard surface in need of cleaning. In an embodiment, the methods include a step of contacting the cleaning composition with water to generate a use solution and thereafter contacting the use solution to the hard surface in need of cleaning. In embodiments, the hard surface is a food preparation surface, a surface in a restaurant, a surface in a grocery store, a household surface, floors and/or surfaces in a commercial drive-thru (such as a drive thru restaurant). In certain embodiments, the hard surface contains food soils, preferably baked on food soils. In embodiments, the hard surface is metal, including soft metals which are conventionally sensitive to or damaged by alkaline cleaning compositions.

While multiple embodiments are disclosed, still other embodiments of the present invention will become apparent to those skilled in the art from the following detailed description, which shows and describes illustrative embodiments of the invention. Accordingly, the figures and detailed description are to be regarded as illustrative in nature and not restrictive.

Figure 1:
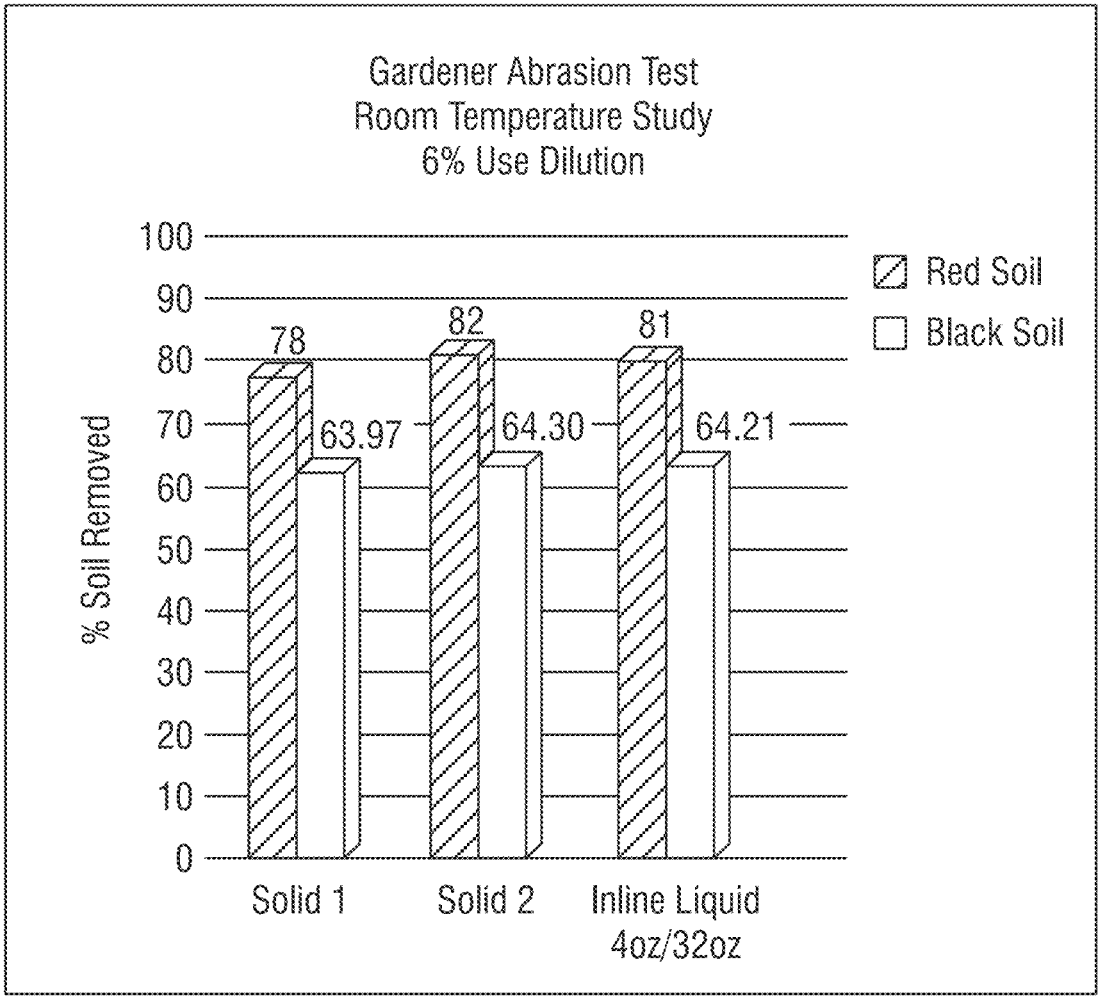
FIG. 1 shows a graph comparing red soil and black soil cleaning efficacy using the Gardener Abrasion Test of evaluated solid hard surface cleaning compositions compared to a liquid Control.

Various embodiments of the present invention will be described in detail with reference to the figures. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The present invention relates to solid hard surface cleaning compositions that provide stable solutions that do not require PPE, provide enhanced cleaning efficacy and are safe for use on soft metals. The embodiments of this invention are not limited to particular hard surface cleaning compositions or methods of using the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers defining the range and include each integer within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges, fractions, and individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6, and decimals and fractions, for example, 1.2, 3.8, 1½, and 4¾ This applies regardless of the breadth of the range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring techniques and equipment, with respect to any quantifiable variable, including, but not limited to, mass, volume, time, and distance. Further, given solid and liquid handling procedures used in the real world, there is certain inadvertent error and variation that is likely through differences in the manufacture, source, or purity of the ingredients used to make the compositions or carry out the methods and the like. The term "about" also encompasses these variations. Whether or not modified by the term "about," the claims include equivalents to the quantities.

As used herein the term "polymer" refers to a molecular complex comprised of a more than ten monomeric units and generally includes, but is not limited to, homopolymers, copolymers, such as for example, block, graft, random and alternating copolymers, terpolymers, and higher "x"mers, further including their analogs, derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule.

The methods and compositions of the present invention may comprise, consist essentially of, or consist of the components and ingredients of the present invention as well as other ingredients described herein. As used herein, "consisting essentially of" means that the methods, systems, apparatuses and compositions may include additional steps, components or ingredients, but only if the additional steps, components or ingredients do not materially alter the basic and novel characteristics of the claimed methods, systems, apparatuses, and compositions.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

The term "surfactant" refers to a molecule having surface activity, including wetting agents, dispersants, emulsifiers, detergents, and foaming agents, and the like. It is understood to be inclusive of the use of a single surfactant or multiple surfactants.

As used herein, the term "cleaning" refers to a method used to facilitate or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

As used herein, the term "disinfectant" refers to an agent that kills all vegetative cells including most recognized pathogenic microorganisms, using the procedure described in *A. O. A. C. Use Dilution Methods*, Official Methods of Analysis of the Association of Official Analytical Chemists, paragraph 955.14 and applicable sections, 15th Edition, 1990 (EPA Guideline 91-2). As used herein, the term "high level disinfection" or "high level disinfectant" refers to a compound or composition that kills substantially all organisms, except high levels of bacterial spores, and is effected with a chemical germicide cleared for marketing as a sterilant by the Food and Drug Administration. As used herein, the term "intermediate-level disinfection" or "intermediate level disinfectant" refers to a compound or composition that kills mycobacteria, most viruses, and bacteria with a chemical germicide registered as a tuberculocide by the Environmental Protection Agency (EPA). As used herein, the term "low-level disinfection" or "low level disinfectant" refers to a compound or composition that kills some viruses and bacteria with a chemical germicide registered as a hospital disinfectant by the EPA.

As used herein, the phrase "food processing surface" refers to a surface of a tool, a machine, equipment, a structure, a building, or the like that is employed as part of a food processing, preparation, or storage activity. Examples of food processing surfaces include surfaces of food processing or preparation equipment (e.g., slicing, canning, or transport equipment, including flumes), of food processing wares (e.g., utensils, dishware, wash ware, and bar glasses), and of floors, walls, or fixtures of structures in which food processing occurs. Food processing surfaces are found and employed in food anti-spoilage air circulation systems, aseptic packaging sanitizing, food refrigeration and cooler cleaners and sanitizers, ware washing sanitizing, blancher cleaning and sanitizing, food packaging materials, cutting board additives, third-sink sanitizing, beverage chillers and warmers, meat chilling or scalding waters, autodish sanitizers, sanitizing gels, cooling towers, food processing antimicrobial garment sprays, and non-to-low-aqueous food preparation lubricants, oils, and rinse additives.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, food processing surfaces.

As used herein, the term "soil" or "stain" refers to a non-polar oily substance which may or may not contain particulate matter such as mineral clays, sand, natural mineral matter, carbon black, graphite, kaolin, environmental dust, etc.

Differentiation of antimicrobial "-cidal" or "-static" activity, the definitions which describe the degree of efficacy, and the official laboratory protocols for measuring this efficacy are considerations for understanding the relevance of antimicrobial agents and compositions. Antimicrobial compositions can affect two kinds of microbial cell damage. The first is a lethal, irreversible action resulting in complete microbial cell destruction or incapacitation. The second type of cell damage is reversible, such that if the organism is rendered free of the agent, it can again multiply. The former is termed microbiocidal and the later, microbistatic. A sanitizer and a disinfectant are, by definition, agents which provide antimicrobial or microbiocidal activity. In contrast, a preservative is generally described as an inhibitor or microbistatic composition. For the purpose of this patent application, successful microbial reduction is achieved when the microbial populations are reduced by at least about 50%, or by significantly more than is achieved by a wash with water. Larger reductions in microbial population provide greater levels of protection.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polypropylene polymers (PP), polycarbonate polymers (PC), melamine formaldehyde resins or melamine resin (melamine), acrylonitrile-butadiene-styrene polymers (ABS), and polysulfone polymers (PS). Other exemplary plastics that can be cleaned using the compounds and compositions of the invention include polyethylene terephthalate (PET) polystyrene polyamide.

As used herein, the term "waters" includes food process or transport waters. Food process or transport waters include produce transport waters (e.g., as found in flumes, pipe transports, cutters, slicers, blanchers, retort systems, washers, and the like), belt sprays for food transport lines, boot and hand-wash dip-pans, third-sink rinse waters, and the like.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Hard Surface Cleaning Compositions Exemplary ranges of the solid hard surface cleaning compositions according to the invention are shown in Table 1 in weight percentage of the solid compositions. The solid compositions may comprise, consist of or consist essentially of the materials set forth in Tables 1A-1B. Without being limited according to the invention, all ranges for the ratios recited are inclusive of the numbers defining the range and include each integer within the defined range of ratios.

TABLE 1A

| Material | First Exemplary Range wt-% | Second Exemplary Range wt-% | Third Exemplary Range wt-% | Fourth Exemplary Range wt-% |
|---|---|---|---|---|
| Alkalinity Source | 10-97 | 10-90 | 20-90 | 30-80 |
| Chelant | 0.1-35 | 0.1-30 | 1-30 | 5-20 |
| Surfactants | 0.1-50 | 0.1-40 | 1-33 | 5-33 |
| Additional Functional Ingredients (e.g. dyes, corrosion inhibitors, pH adjusters) | 0-30 | 0.1-25 | 1-20 | 1-15 |

TABLE 1B

| Material | First Exemplary Range wt-% | Second Exemplary Range wt-% | Third Exemplary Range wt-% | Fourth Exemplary Range wt-% |
|---|---|---|---|---|
| Carbonate Alkalinity Source | 10-97 | 10-90 | 20-90 | 30-80 |
| Chelants | 0.1-35 | 0.1-30 | 1-30 | 5-20 |
| Amphoteric Surfactant | 0.1-40 | 0.1-35 | 1-33 | 5-20 |
| Anionic Surfactant | 0.1-50 | 0.1-40 | 1-33 | 10-30 |
| Corrosion Inhibitor | 0.01-10 | 0.1-10 | 0.1-8 | 1-8 |
| Additional Functional Ingredients (e.g. dyes, pH adjusters) | 0-30 | 0.1-25 | 1-20 | 1-15 |

In an aspect, the solid compositions have a water content of less than about 15% by weight, less than about 10% by weight, less than about 15%-10 by weight, less than about 7% by weight, less than about 5% by weight, less than about 1% by weight, less than about 0.5% by weight, or less than about 0.1% by weight. In a preferred aspect, the solid compositions do not include water as a raw material; however, water can be included in components of the solid compositions.

It is a benefit of the solid compositions to overcome solubility limitations of liquid compositions to provide higher concentrations of surfactants and/or alkalinity. In an embodiment, the amphoteric surfactant and the anionic surfactant comprise at least about 20 wt-%, at least about 25 wt-%, or at least 30 wt-% of the solid cleaning composition.

The solid hard surface cleaning compositions are preferably provided as concentrate compositions which may be diluted to form use compositions. In general, a concentrate refers to a composition that is intended to be diluted with water to provide a use solution that contacts an object to provide the desired cleaning, sanitizing, or the like. The solid hard surface cleaning compositions that contacts the articles to be washed can be referred to as a concentrate or a use composition (or use solution) dependent upon the formulation employed in methods. It should be understood that the concentration of the alkalinity, surfactants, chelants and other components in the solid hard surface cleaning compositions will vary depending on the concentrated nature of the formulation and the desired use solution thereof.

The solid hard surface cleaning compositions provide stabilized use compositions, including ready-to-use (RTU) compositions. Such shelf stability of the use composition may be important for applications of use that keep a use dilution for use over an extended period of times, such as days, weeks or longer. Beneficially, the use compositions of the solid compositions maintain shelf stability for at least about 1 year, or at least about 6 months, at room temperature. Moreover, the solid hard surface cleaning compositions maintain shelf stability in solid form, including at elevated storage temperatures, including for example at temperatures up to at least 40° C. (or 100° F.) for at least 8 weeks with a growth exponent (or change in dimension of the solid) of less than about 3%, demonstrating shelf stability at room temperature or ambient temperatures for at least about 1 year. It was unexpected for the solid hard surface cleaning compositions to exhibit both solid stability and use composition stability for extended periods of time, including use composition stability that is superior to a liquid composition.

In some aspects, the solid compositions when diluted to form a use composition have a pH below about 11, or between about 8 and about 11.

Alkalinity Source

The solid hard surface cleaning composition includes an effective amount of one or more alkalinity sources to enhance cleaning of a substrate and improve soil removal performance at a use pH of less than about 11, or between about 8 and about 11. A preferred pH is less than about 11 to ensure the use of PPE is not required. The solid hard surface cleaning compositions include between about 10% by weight and about 97% by weight, between about 10% by weight and about 90% by weight, between about 20% by weight and about 90% by weight, between about 30% by weight and about 80% by weight, or between about 30% by weight and about 70% by weight.

Examples of suitable alkaline sources for the solid hard surface cleaning compositions include, but are not limited to an alkali metal carbonates. Exemplary alkali metal carbonates that can be used include, but are not limited to sodium or potassium carbonate, bicarbonate, sesquicarbonate, and mixtures thereof. Additional alkalinity sources include, for example, metal silicates such as sodium or potassium silicate or metasilicate; metal carbonates such as sodium or potassium carbonate, bicarbonate, sesquicarbonate; metal borates such as sodium or potassium borate; and ethanolamines and amines.

Preferred solid hard surface cleaning compositions do not include any alkali metal hydroxides, including for example potassium or sodium hydroxide.

Chelant

The hard surface cleaning compositions include at least one chelant or chelating agent. In preferred embodiments, the hard surface cleaning compositions include at least two chelants or chelating agents. Various chelants can be employed to coordinate (i.e., bind) the metal ions commonly found in natural water to prevent the metal ions from interfering with the action of the other detersive ingredients of a cleaning composition. In general, chelants can generally be referred to as a type of builder and may also function as a threshold agent when included in an effective amount.

A preferred chelant is an aminocarboxylic acid include, for example, methylglycinediacetic acid (MGDA), N, N-dicarboxymethyl glutamic acid (GLDA), N-hydroxyethyliminodiacetic acid, nitrilotriacetic acid (NTA), ethylenediaminetetraacetic acid (EDTA), N-hydroxyethylethylenediaminetriacetic acid (HEDTA), diethylenetriaminepentaacetic acid (DTPA), ethylenediaminetetraproprionic acid triethylenetetraaminehexaacetic acid (TTHA), and the respective alkali metal, ammonium and substituted ammonium salts thereof.

Additional chelants include: phosphonates, including phosphonic acid; phosphates, including condensed phosphates such as sodium and potassium orthophosphate, sodium and potassium pyrophosphate, sodium tripolyphosphate, sodium hexametaphosphate, and the like; organic chelating agents, including both polymeric and small molecule chelating agents such as organocarboxylate compounds or organophosphate chelating agents; polymeric chelating agents, including polyanionic compositions such as polyacrylic acid compounds.

The chelants may also be a water conditioning polymer that can be used as a form of builder. Such suitable sequestrants include water soluble polycarboxylate polymers. Such homopolymeric and copolymeric chelating agents include polymeric compositions with pendant (—$CO_2H$) carboxylic acid groups and include polyacrylic acid, polymethacrylic acid, polymaleic acid, acrylic acid-methacrylic acid copolymers, acrylic-maleic copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers or copolymers such as their respective alkali metal (for example, sodium or potassium) or ammonium salts can also be used. The weight average molecular weight of the polymers is from about 400 to about 20,000 g/mol. An example of commercially available polycarboxylic acids (polycarboxylates) is ACUSOL 445 which is a homopolymer of acrylic acid with an average molecular weight of 4500 (Dow Chemicals). ACUSOL 445 is available as partially neutralized, liquid detergent polymer.

Exemplary polymers include polyacrylic acid, the partial sodium salts of polyacrylic acid or sodium polyacrylate having an average molecular weight within the range of 4000 to 8000. Further exemplary polymers include polycarboxylates, such as polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers.

The solid hard surface cleaning compositions include chelants in amounts from about 0.01 to 50% by weight, from about 0.1 to 35% by weight, from about 0.1 to 30% by weight, from about 1 to 30% by weight, or preferably from about 5 to 20% by weight.

Surfactants

The solid hard surface cleaning compositions include at least one surfactant, or at least two surfactants. Preferred surfactants suitable for use with the compositions include, but are not limited to, anionic surfactants and amphoteric (including zwitterionic) surfactants. In some embodiments, the solid hard surface cleaning compositions include between about 0.1 wt-% to about 50 wt-% surfactants, between about 0.1 wt-% to about 40 wt-% surfactants, between about 1 wt-% to about 40 wt-% surfactants, between about 1 wt-% to about 33 wt-% surfactants, or between about 5 wt-% to about 33 wt-% surfactants.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" Cosmetics & Toiletries, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines. Long chain imidazole derivatives generally have the general formula:

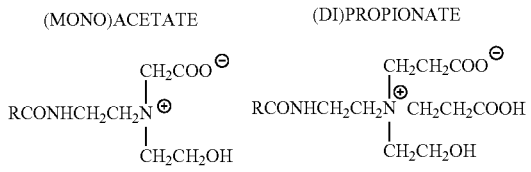

Neutral pH-Zwitterion

-continued

AMPHOTERIC SULFONATE

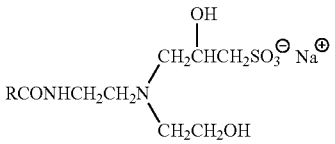

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

Additional suitable surfactants include amine oxide surfactants having the formula:

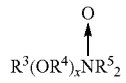

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. $R^5$ groups can be attached to each other, e.g., through an oxygen or nitrogen atom, to form a ring structure. Exemplary amine oxide surfactants are $C_{10}$-$C_{18}$ alkyldimethylamine oxides and $C_8$-$C_{12}$ alkoxyethyldihydroxyethylamine oxides. Further exemplary amine oxides include lauramine oxide, also referred to as Lauryldimethylamine oxide; Lauryldimethylamine N-oxide; Dodecyldimethylamine N-oxide; Dodecyldimethylamine oxide; $C_{14}H_{31}NO$.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants are a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

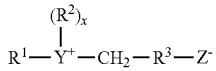

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

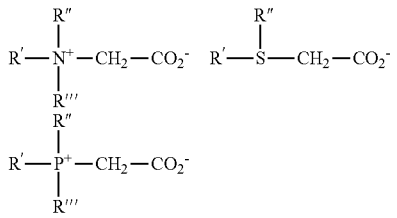

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Particularly suitable sultaines include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references is herein incorporated in their entirety.

In an embodiment, the solid hard surface cleaning compositions include an amine oxide and/or a betaine and/or a sultaine.

In some embodiments, the solid hard surface cleaning compositions include between about 0.1 wt-% to about 40 wt-% amphoteric surfactant, between about 0.1 wt-% to about 35 wt-% amphoteric surfactant, between about 1 wt-% to about 40 wt-% amphoteric surfactant, between about 1 wt-% to about 33 wt-% amphoteric surfactant, or between about 5 wt-% to about 20 wt-% amphoteric surfactant.

Anionic Surfactants

The solid hard surface cleaning compositions include at least one anionic surfactant. In some embodiments more than one anionic surfactant may be employed. Anionic surfactants are surface active substances having a negative charge on the hydrophobe or have a hydrophobic section that carries no charge unless the pH is elevated to neutrality or above (e.g. carboxylic acids). Carboxylate, sulfonate, sulfate, and phosphate are the polar (hydrophilic) solubilizing groups found in anionic surfactants. Of the cations (counter ions) associated with these polar groups, sodium, lithium, and potassium impart water solubility; ammonium and substituted ammonium ions provide both water and oil solubility; and, calcium, barium, and magnesium promote oil solubility.

In a preferred aspect, the anionic surfactant(s) are either not combined with any nonionic surfactants or combined with amounts of nonionic surfactant(s) which do not interfere with the stability of the solid compositions. Nonionic surfactants are not included as the primary surfactant in the solid hard surface cleaning compositions as they are not able to be produce sufficiently concentrated solid formulations.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). Further examples of suitable anionic surfactants are given in "Surface Active Agents and Detergents" (Vol. I and II by Schwartz, Perry and Berch). A variety of such surfactants are also generally disclosed in, for example, U.S. Pat. No. 3,929,678. The disclosures of the above references relating to anionic surfactants are incorporated herein by reference.

Anionic surfactants suitable for use in the solid compositions include sulfonates, sulfates, phosphates, and carboxylates. In particular, linear alkyl aryl sulfonates, alkylarylcarboxylates and akylarylphosphates are suitable anionic surfactants. Exemplary anionic sulfate surfactants include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly (ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, sulfonated fatty acids, such as sulfonated oleic acid, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkyl aryl ethoxy carboxylates of the following formula:

$$R—O—(CH_2CH_2O)_n(CH_2)_m—CO_2X \quad (3)$$

in which R is a $C_8$ to $C_{22}$ alkyl group or

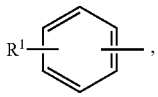

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

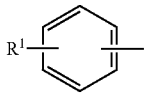

and $R^1$ is a $C_6$-$C_{12}$ alkyl group. In still yet other embodiments, $R^1$ is a $C_9$ alkyl group, n is 10 and m is 1.

In some embodiments, the anionic surfactant selected is an olefin sulfonate, such as a $C_{14}$-$C_{16}$ olefin sulfonate, dodecene-1-sulfonic acid, sodium salt solution, Sodium Lauryl Ether Ethoxy Sulfate, an alcohol sulfate and derivatives and mixtures thereof. In a preferred embodiment, the composition does not include linear alkyl benzene sulfonate or any other anionic surfactant that negatively interferes with the composition stability, namely the use solution stability.

In some embodiments, the solid hard surface cleaning compositions include between about 0.1 wt-% to about 50 wt-% anionic surfactant, between about 0.1 wt-% to about 40 wt-% anionic surfactant, between about 1 wt-% to about 40 wt-% anionic surfactant, between about 1 wt-% to about 33 wt-% anionic surfactant, or between about 10 wt-% to about 30 wt-% anionic surfactant.

Nonionic Surfactants

The solid hard surface cleaning compositions can optionally include at least one nonionic surfactant. Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available from BASF Corp. One class of compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Another class of compounds are tetra-flinctional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Lutensol™, Dehydol™ manufactured by BASF, Neodol™ manufactured by Shell Chemical Co. and Alfonic™ manufactured by Vista Chemical Co.

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Disponil or Agnique manufactured by BASF and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

The alkylphenoxypolyethoxyalkanols of U.S. Pat. No. 2,903,486 issued Sep. 8, 1959 to Brown et al. and represented by the formula

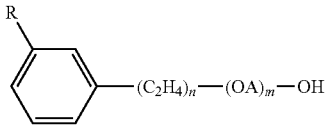

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkylene oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n\ (C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n\ (C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n\ (C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

Polyhydroxy fatty acid amide surfactants suitable for use in the present compositions include those having the structural formula $R_2CON_{R1}Z$ in which: $R_1$ is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.

Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or —$(C_2H_4O)_xH$, where x is in the range of from 1 to 3.

A useful class of non-ionic surfactants include the class defined as alkoxylated amines or, most particularly, alcohol alkoxylated/aminated/alkoxylated surfactants. These non-ionic surfactants may be at least in part represented by the general formulae: $R^{20}$—$(PO)_sN$-$(EO)_tH$, $R^{20}$—$(PO)_sN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise Nonionic Surfactants, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch). Additional nonionic surfactants can include those often defined as semi-polar nonionic surfactants, the disclosure of which in U.S. Patent Publication No. 2018-0110220 which is herein incorporated by reference in its entirety.

Corrosion Inhibitors

The solid hard surface cleaning compositions can include one or more corrosion inhibitors for use for in cleaning of alkaline sensitive metals such as aluminum or aluminum containing alloys. The corrosion inhibitors must not negatively interference with the solid and/or use composition stability unexpectedly formulated for the solid hard surface cleaning compositions. Preferred corrosion inhibitors that maintain stability of the compositions include silicates and metasilicates, preferably alkali metal silicates and metasilicates, such as sodium silicate and sodium metasilicate. Anhydrous forms may be employed such as sodium metasilicate anhydrous.

Additional exemplary corrosion inhibitors include for example, an imidazoline compound, a quaternary ammonium compound, a pyridinium compound, or a combination thereof. Still further exemplary corrosion inhibitors can include for example a phosphate ester, monomeric or oligomeric fatty acid, alkoxylated amine, or mixture thereof. Disclosure of such exemplary corrosion inhibitors are set forth in U.S. application Ser. No. 16/775,417, the entire content of which are incorporated by reference herein in its entirety.

In some embodiments, the solid hard surface cleaning compositions include between about 0 wt-% to about 10 wt-% corrosion inhibitor, between about 0.01 wt-% to about 10 wt-% corrosion inhibitor, between about 0.1 wt-% to about 10 wt-% corrosion inhibitor, between about 0.1 wt-% to about 8 wt-% corrosion inhibitor, or between about 1 wt-% to about 8 wt-% corrosion inhibitor.

Additional Functional Ingredients

The components of the solid hard surface cleaning composition can further be combined with various functional components suitable for uses disclosed herein. In some embodiments, the solid hard surface cleaning compositions including the carbonate alkalinity, chelants, surfactants and optionally corrosion inhibitor, which make up a large amount, or even substantially all of the total weight of the compositions. For example, in some embodiments few or no additional functional ingredients are disposed therein.

In other embodiments, additional functional ingredients may be included in the solid hard surface cleaning compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning. However, other embodiments may include functional ingredients for use in other applications.

In some embodiments, the solid hard surface cleaning compositions may include optical brighteners, pH modifiers, defoaming agents, soil anti-redeposition agents, bleaching agents, additional surfactants (e.g. nonionics), solubility modifiers, dispersants, metal protecting agents, stabilizing agents, additional builders/sequestrants/chelating agents, enzymes, aesthetic enhancing agents including fragrances and/or dyes, rheology and/or solubility modifiers or thickeners, hydrotropes or couplers, buffers, solvents, additional cleaning agents and the like.

According to embodiments, the various additional functional ingredients may be provided in a composition in the amount from about 0 wt-% to about 30 wt-%, from about 0 wt-% to about 25 wt-%, from about 0.1 wt-% to about 25 wt-%, from about 1 wt-% to about 20 wt-%, or from about 1 wt-% to about 15 wt-%. In addition, without being limited according to the invention, all ranges recited are inclusive of the numbers defining the range and include each integer within the defined range.

Solid Compositions

The solid hard surface cleaning compositions are substantially homogeneous with regard to the distribution of ingredients throughout its mass and is dimensionally stable. The solid hard surface cleaning compositions are hardened compositions that will not flow and will substantially retain its shape under moderate stress or pressure or mere gravity. The degree of hardness of the solid hard surface cleaning composition may range from that of a fused solid block which is relatively dense and hard, for example, like concrete, to a consistency characterized as being a hardened paste. In addition, the term "solid" refers to the state of the solid hard surface cleaning composition under the expected conditions of storage and use. In general, it is expected that the solid hard surface cleaning composition will remain in solid form when exposed to temperatures of up to about 100° F. and preferably greater than about 120° F. The solids are dimensionally stable, meaning the solids do not swell (or change in dimension due to swelling), this is measured according to a swelling of less than 3% at temperatures of up to 40° C. (or 100° F.) for at least 8 weeks. Such solids are referred to as dimensionally stable.

The solid hard surface cleaning composition may take forms including, but not limited to a pressed solid; a cast solid block; an extruded, molded or formed solid pellet, block, tablet, powder, granule, flake; or the formed solid can thereafter be ground or formed into a powder, granule, or flake.

In certain embodiments, the solid hard surface cleaning composition could be provided in the form of a unit dose. A unit dose refers to a composition unit sized so that the entire unit is used during a single cleaning cycle. When the solid hard surface cleaning composition is provided as a unit dose, it is preferably provided as a pressed solid, cast solid, an extruded pellet, or a tablet having a size of between approximately 1 gram and approximately 50 grams.

In other embodiments, the solid hard surface cleaning composition is provided in the form of a multiple-use solid, such as a block or a plurality of pellets, and can be repeatedly used to generate aqueous compositions for multiple cleaning cycles. In certain embodiments, the solid hard surface cleaning composition is provided as a pressed solid, cast solid, an extruded block, or a tablet having a mass of between approximately 5 grams and approximately 10 kilograms. In certain embodiments, a multiple-use form of the solid hard surface cleaning composition has a mass between approximately 1 kilogram and approximately 10 kilograms. In further embodiments, a multiple-use form of the solid hard surface cleaning composition has a mass of between approximately 1 kilogram and about approximately 5 kilograms. In other embodiments, a multiple-use form of the solid hard surface cleaning composition has a mass of between about approximately 5 grams and approximately 1 kilogram, or between approximately 5 grams and approximately 500 grams.

Methods of Cleaning Hard Surfaces

The hard surface cleaning compositions disclosed herein are particularly suitable for replacing liquid compositions and beneficially providing a higher concentration of surfactants in comparison to a liquid composition. Moreover, the compositions further beneficially provide a higher concentration of alkalinity in comparison to a liquid composition. They provide stable use compositions that quickly dissolve in water and form a stable, clear use solution. The stable use compositions do not exhibit precipitation upon storage and/or use. Moreover, neither the solid compositions nor the liquid use compositions require use of personal protective equipment (PPE) as they are safe for contact, including skin and eyes. The use solution of the hard surface cleaning compositions is compatible with metal surfaces, including soft metals.

The hard surface cleaning compositions are particularly suitable for cleaning hard surfaces soiled with food soils, including food preparation surfaces. Exemplary food preparation surfaces include surfaces in a restaurant, surfaces in a grocery store, and/or a household surfaces. In addition, various floor cleaning surfaces are included for use of the hard surface cleaning composition, including for example floors in kitchens, restaurants, the like, and/or drive-thrus. Despite the exclusion of hydroxide alkalinity sources from the compositions, the hard surface cleaning compositions disclosed herein containing carbonate alkalinity and solidification matrix provide effective removal of food soils, including baked on soils such as polymerized fats and oils.

It is surprising and unexpected that the stability of the solid compositions in a ready-to-use composition provided long term stability. For example, in certain embodiments the use (or ready-to-use (RTU)) compositions can be stable for use up to or beyond one year at room temperature. This is beneficially as dilution of the solid composition into a use composition can then also be stored for an extended prior of time prior to use, or during intermittent use. This could include, for example, storage of a diluted composition in a container. This could further include, for example, a use composition remaining in a sump of a machine.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Materials Used:

Bioterge® AS-90: alpha olefin sulfonate anionic surfactant (sodium $C_{14}$-$C_{16}$ alpha olefin sulfonate), available from Stepan.

Acusol® 445 ND: a polycarboxylic acid, sodium salt of acrylic polymer (sodium polyacrylate), available from Dow Chemical.

Trilon M® granules: trisodium salt of methylglycinediacetic acid, N, N-bis(carboxymethyl)-tri-sodium salt, available from BASF.

Barlox 12®: Lauramine Oxide 30% (lauryldimethlamine oxide (30%)), available from Lonza.

Premix of AOS/SLES: combination of alpha-olefin sulfonate and sodium lauryl ether sulfate.

Commercially available alkalinity sources: sodium carbonate, sodium bicarbonate

Commercially available corrosion inhibitors: sodium gluconate, sodium silicate, sodium metasilicate anhydrous, and sodium metasilicate pentahydrate.

Evaluated solid compositions in the Examples are set forth in Table 2.

TABLE 2

| Solid Hard Surface | | | |
|---|---|---|---|
| | Cleaning Compositions (wt-%) | | |
| Ingredient | 1 | 2 | 3 |
| Sodium Carbonate | 55 | 55 | 50.34 |
| Trilon M granules | 10 | 10 | 10 |
| Barlox 12, 30% | 10 | 10 | 10 |
| Acusol 445 ND | 5 | 5 | 5 |
| Bio Terge AS 90 Coarse (AOS solid) | 0 | 20 | 20 |
| AOS/SLES Premix (solid) | 20 (16/4) | 0 | 0 |
| Sodium metasilicate anhydrous | 0 | 0 | 1.33 |
| Sodium bicarbonate | 0 | 0 | 3.33 |

Control liquid compositions in the Examples are set forth in Table 3.

TABLE 3

| Ingredient | Liquid Hard Surface Cleaning Compositions (wt-%) |
|---|---|
| Alkalinity sources | 5-40, preferably 5-10 |
| Chelant | 5-12 |
| Surfactants | 4-10 |
| Corrosion Inhibitor | 0.5-2 |
| Fragrances and Dyes | 0-1 |
| Water | Remainder |

Example 1

Red Soil and Black Soil Removal Test

Soil removal testing was completed to quantitatively differentiate cleaning performance of multiple cleaners using the Gardner Abrasion Tester, which simulates mechanical action during cleaning. Exemplary solid multi-surface cleaner compositions were prepared as a pressed solid tablet. Solid compositions 1 and 2 were tested at a 6% use concentration, in comparison to the inline liquid Control at a 10-11% use dilution.

Black oily soil and Red food soil were used on vinyl white tiles to differentiate test formulas and inline liquid products. Equipment used included: BYK-Gardner Abrasion Tester AG-8100; QA Lab Spectrophotometer; and Gardner Sponge Holder AG-8115. 12"×12" Square White Vinyl tiles were cut down to 3"×3" squares with a tile cutter.

A "black soil" was made from a oily soils containing mineral spirits, mineral oil, motor oil, graphite lube and black clay (an exemplary proteinaceous food soil referred to as "black soil" throughout the Examples). About 50 grams of mineral spirits was combined with about 5 grams of mineral oil, about 5 grams of 10/30 W motor oil, about 2.5 grams of graphite lube (black pigment dispersion), and about 37.5 grams of bandy black clay.

A "red soil" was made from a food soil containing protein from lard, oil, protein, and iron (III) oxide (for color) (an exemplary proteinaceous food soil referred to as "red soil" throughout the Examples). About 30 grams of lard was combined with about 30 grams of corn oil, about 15 grams of whole powdered egg, and about 1.5 grams of $Fe_2O_3$.

Tiles soiled with red soil were prepared and tiles soiled with black soil were also prepared. The back, grooved sides of a plurality of 3"×3" white vinyl tiles were soiled with approximately 0.75 grams of the soil using a 3" foam brush. The black oily soil tiles were placed at room temperature overnight and allowed to dry. The red soil tiles were allowed to dry at room temperature overnight. The next day, the tiles were placed into a soaking tray containing about 200 grams of a test composition for about 1 minute for the red soil and about 2 minutes for the black soil.

The soil removal test was conducted using Gardco Washability Test Equipment Model D10V available from Paul N. Gardner Company Inc., using a synthetic sponge. 180-200 grams of the test compositions were poured into the tray under the sponge holder to ensure the solution covered the tiles. For black oily soiled tiles, the solution was allowed to sit for 2 minutes before testing. For red food soiled tiles, the solution was allowed to sit for 1 minute before testing. The testing was completed at room temperature.

The tiles were then placed into the Gardco with the grain of the tiles parallel to the direction of sponge travel.

For the black oily soiled tiles, allow the sponge and sponge holder to move across the tiles in 10 passes (1 cycle). (Back and forth is one pass). After 10 passes, stop the Gardner Abrasion Tester and rotate the tiles 90 degrees. Allow a max of 10 seconds between cycles to rotate the tiles. Run a total of 4 cycles (40 passes) for each test solution.

For the red food soil, allow the sponge and sponge holder to move across the tiles in 4 passes (1 cycle). (Back and forth is one pass). After 4 passes, stop the Gardner Abrasion Tester and rotate the tiles 90 degrees. Allow a max of 10 seconds between cycles to rotate the tiles. Run a total of 4 cycles (16 passes) for each test solution.

After running the test of two tiles, remove the tiles from the solution and rinse under cold water at low pressure. Allow the tiles to dry on the drying rack at an angle overnight. Rinse the tray and standard holding tiles in water and dry after each test solution, using a dish soap and rinse if needed to remove soil.

FIG. 1 shows a graph comparing the red soil and black soil cleaning efficacy of exemplary solid hard surface cleaning compositions Solid 1 and Solid 2 compared to the liquid Control. The graph shows that the solid formulas provide comparable cleaning efficacy to the inline liquid control for both black and red soil efficacy, at a lower use concentration. This is beneficial, that the solid compositions 1 and 2 tested at a 6% use concentration provide equivalent cleaning performance to the liquid Control at a 10-11% use dilution (4 oz/32 oz). This suggests that at equivalent use concentrations the solid formulations disclosed herein would outperform the liquid control providing both formulation and use benefits.

Example 2

Red Soil Removal Test

The test procedures of Example 1 was completed using baked on food soils and compared Solid 1 to the inline liquid Control. The testing procedures of Example 1 for the Gardener Abrasion testing were completed with the modification of using stainless steel for testing baked on food soils. Testing was completed using 17 grain water and compared 6% use concentration of Solid 1 to a 1:9 use dilution of the inline liquid Control, which provides 10-11% use concentration. The cleaning compositions were in contact with the soiled tiles for 10 minutes. This represents a very short contact time in comparison to commercial applications where baked on food soils are most often allowed to soak in chemistry overnight (hours of contact time).

Figure 2:
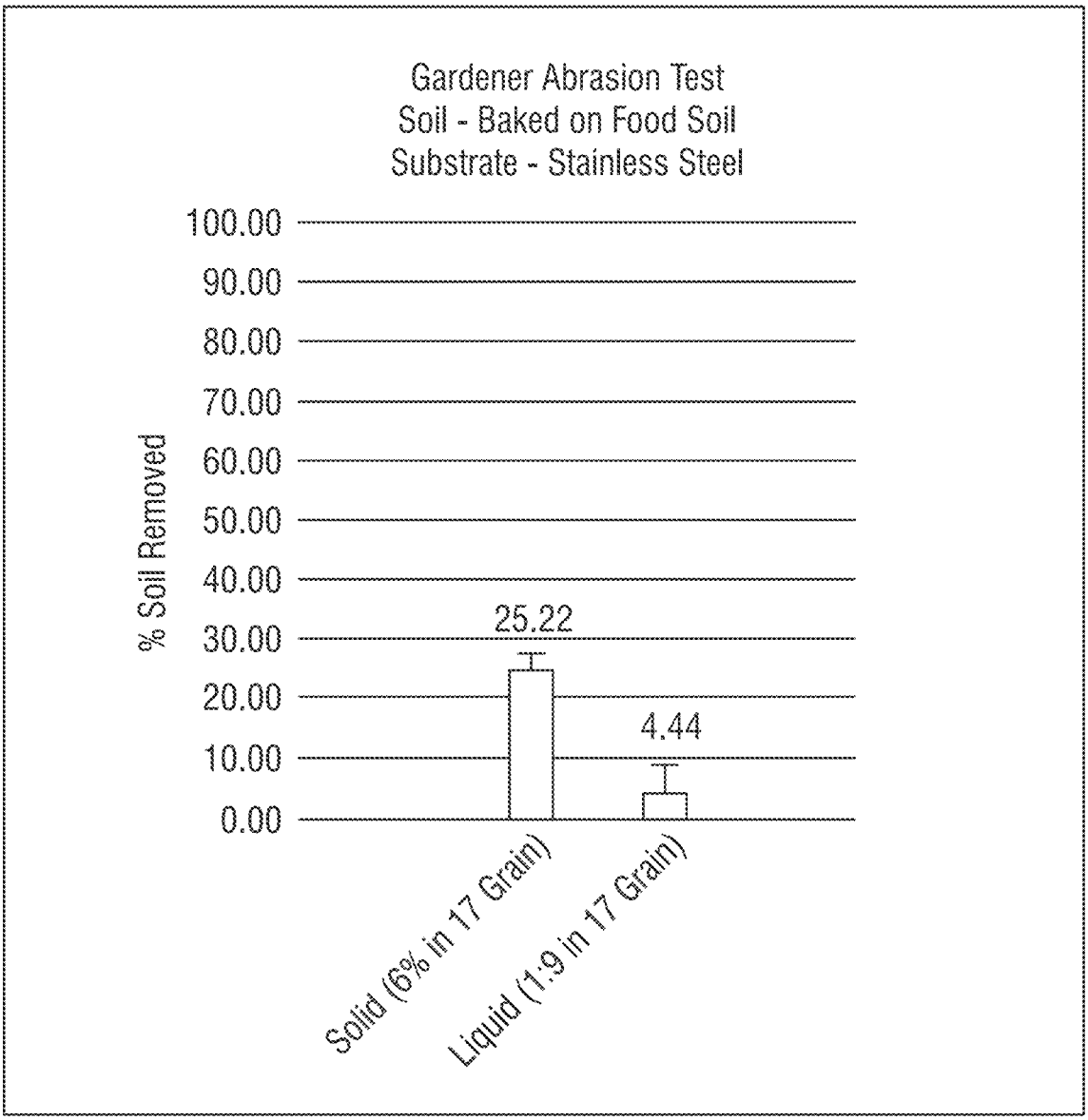
FIG. 2 shows a graph comparing baked on food soil cleaning efficacy using the Gardener Abrasion Test of an evaluated solid hard surface cleaning composition compared to a liquid Control.

FIG. 2 shows a graph comparing the percent baked on food soil removal by the solid composition compared to the Control. Even at only 10 minutes contact time (compared to hours to overnight exposure that would be expected in commercial applications of the chemistry) the solid compositions provides significantly better cleaning performance for removing baked on food soils.

Example 3

Soaking Test

Exemplary solid multi-surface cleaner compositions were prepared as a pressed solid tablet. Thereafter, static soaking tests were conducted to evaluate substrates for soil removal by weigh change using an analytical balance. The testing was conducted to assess soil removal on multiple substrates such as 304 Stainless steel and vinyl tiles. The static method does not employ any mechanical motion or scrubbing to assist in removing soils. The procedures for making black and red soils as described in Example 1 were followed. The following procedure was followed to compare the Solid 1 formulation against the inline liquid composition (Tables 2-3 above):

1. Put on gloves then weigh a clean substrate on an analytical balance. Record the weight to 4 decimals then tare the balance.

2. Apply soil to the substrate at ambient temperature and spread evenly using your finger/glove but leave about a ¼ in-½ in area around the perimeter of the substrate where no soil is applied. This will help mitigate any inadvertent soil removal from handling the substrate. Ensure the soil & substrate is at ambient temperature prior to weighing it.

3. Reweigh the substrate to determine final weight which should be 0.050 g+/−0.005 g. Record this weight to 4 decimals.

4. Repeat steps 1-3 for a minimum of six substrates

5. Make up enough use solution of the desired concentration at 77° F.+/−2° F. to cover each of the six substrates in their respective containers by ⅛ in. Example: 150 mLs of solution covers a 3×6" SS panel by ⅛ in in this container so make up 900-1000 mL of solution for 6 containers and transfer 150 mL into a graduated cylinder then transfer that amount into each container.

6. Add the 77° F.+/−2° F. use solution to the 32 oz Rubbermaid container. Do this for each of the 6 containers.

7. Holding the soiled/pre-weighed substrates by the edges; immerse the substrate, soil side up, into the container of use solution and allowed to dwell for 10 minutes using a stopwatch. Only have one substrate per container and do this for all six.

8. Remove the substrates one at a time in the same order they were immersed in the use solution and rinse by immersing (do not move back & forth to create agitation but rather just dip once) in a clean beaker one at a time for 2 seconds in enough 77° F.+/−2° F. water to completely cover the substrate. Example: 1500-2000 mLs of water is enough to completely cover a 3×6" SS panel using your hands holding the edges of the substrates is the preferred method. Only dip one substrate per clean rinse beaker.

9. Note that the soil, use solution, & rinse water temperatures can vary based on use application needs but it's recommended to keep consistent +/−2° F. per study to reduce variation in results.

10. Remove from rinse immersion after the 2 seconds and allow excess water to drain off from the substrate then place the substrate soil side up on a block, jar cap, or paper towel to allow air drying at ambient temperatures. Once no moisture is visible on the soiled side, wipe the back of the substrate dry with a Kimwipe as to not leave behind any fibers. Optionally one can allow the substrates to air dry overnight at ambient temperatures without seeing a significant weight difference.

11. Reweigh the substrates on an analytical balance when dry. Record the weight out to 4 decimals. Final Substrate wt after clean (g)−Initial Substrate wt (g)=Residual soil wt (g)

$$100 - \left[\frac{\text{Residual soil wt (g)}}{\text{Soil wt (g)} \times 100}\right] = \%\ \text{Soil Removal}$$

Figure 3:
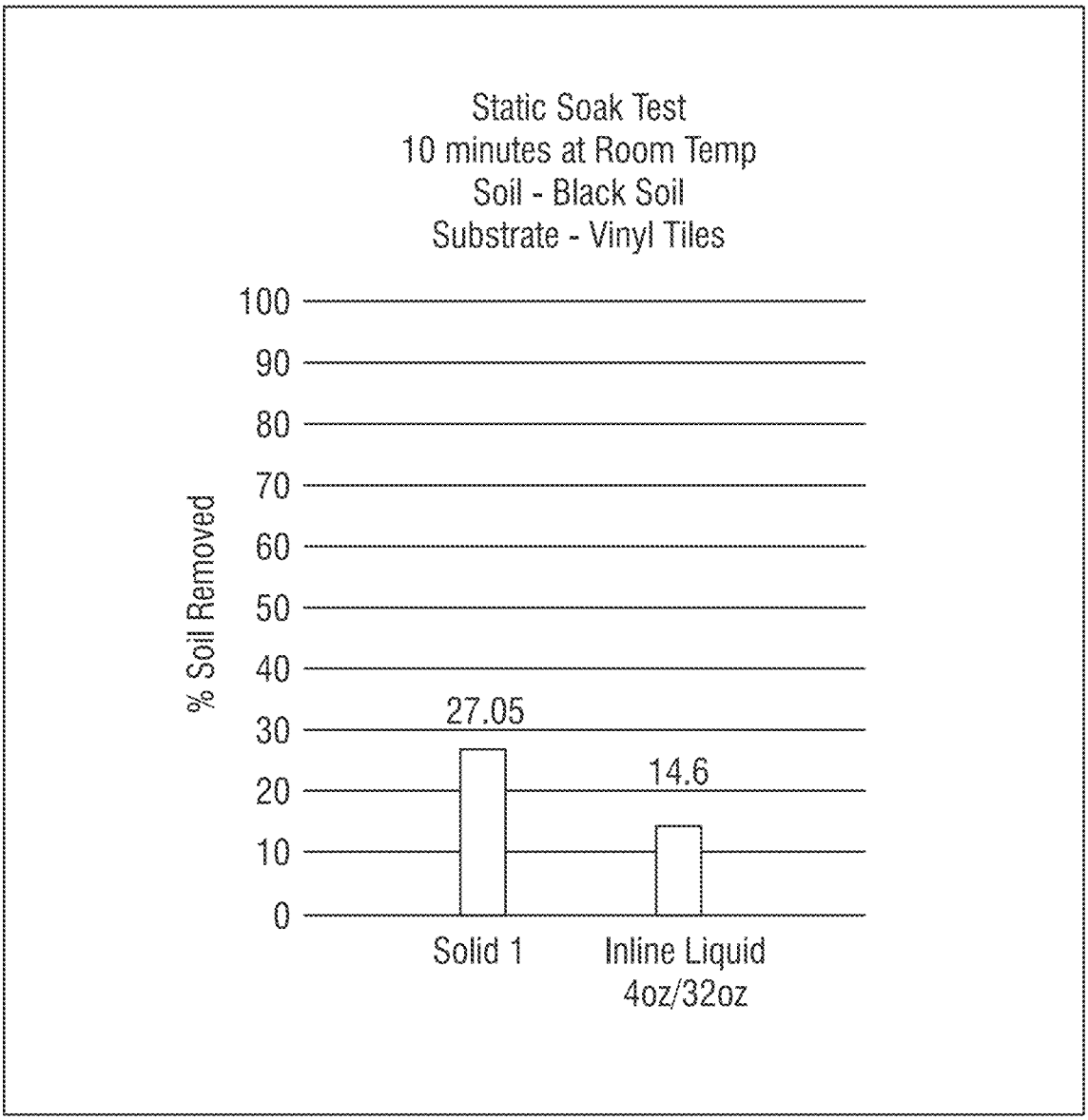
FIG. 3 shows a graph comparing black soil cleaning efficacy in a static soak test of an evaluated solid hard surface cleaning composition compared to a liquid Control.

FIG. 3 shows the percentage of soil removal of Solid 1 composition compared to the liquid Control (again 6% use concentration of Solid 1 compared to a 4 oz/32 oz dilution of the inline liquid Control, which provides 10-11% use concentration). The Solid 1 composition removed a greater amount of black soil from vinyl tiles, as are typically found of floors, after a 10 minute soak at room temperature compared to the liquid Control.

Figure 4:
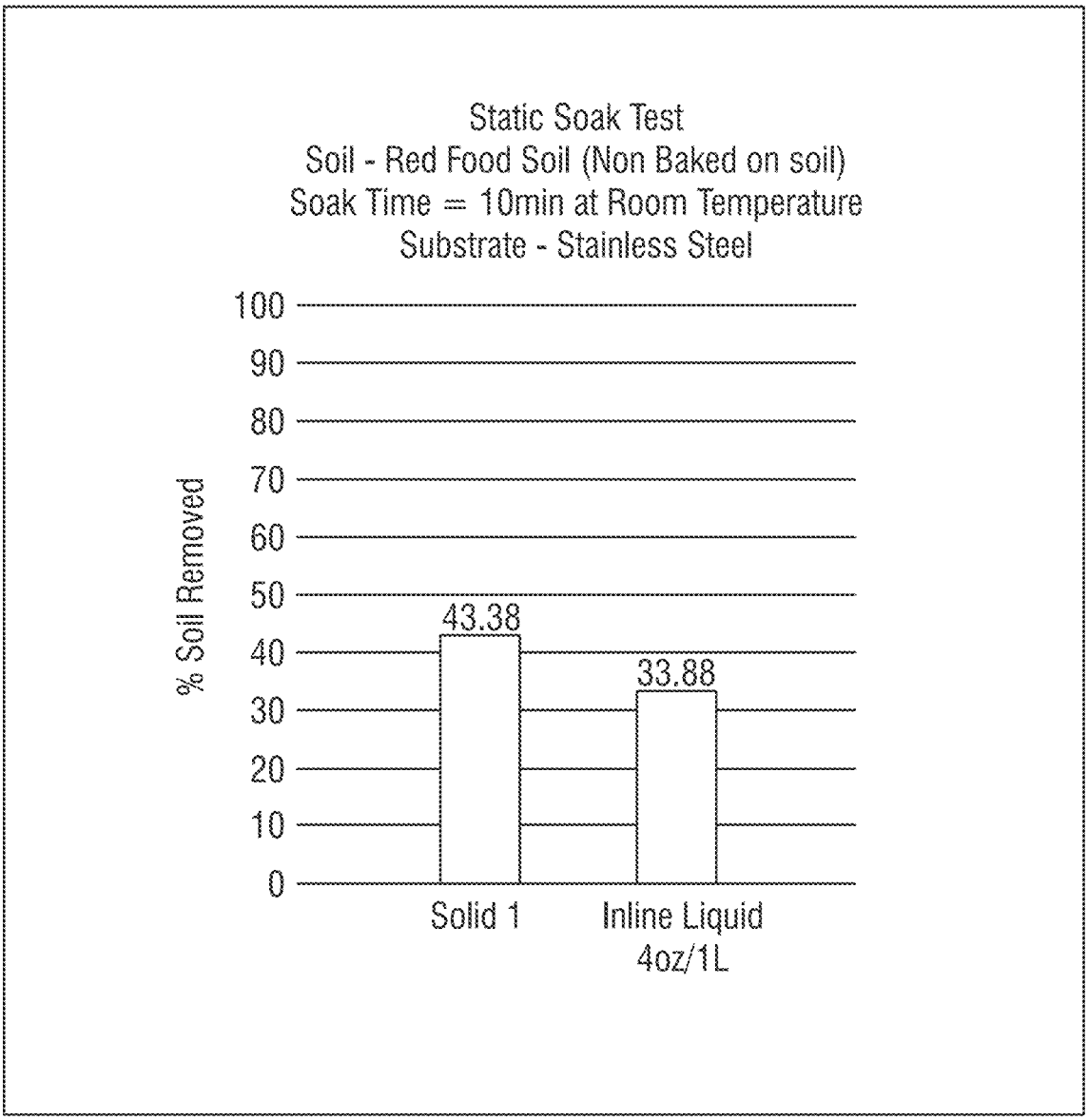
FIG. 4 shows a graph comparing red soil cleaning efficacy in a static soak test on non-baked on food soils of an evaluated solid hard surface cleaning composition compared to a liquid Control.

FIG. 4 shows the percentage of soil removal of Solid 1 composition compared to the liquid Control (again 6% use concentration of Solid 1 compared to a 4 oz/1 L dilution of the inline liquid Control, which provides 10-11% use concentration). The Solid 1 composition removed a greater amount of red food soil (non-baked on soil as are customarily found in fresh food soils) from stainless steel panels after a 10 minute soak at room temperature compared to the liquid Control.

Figure 5:
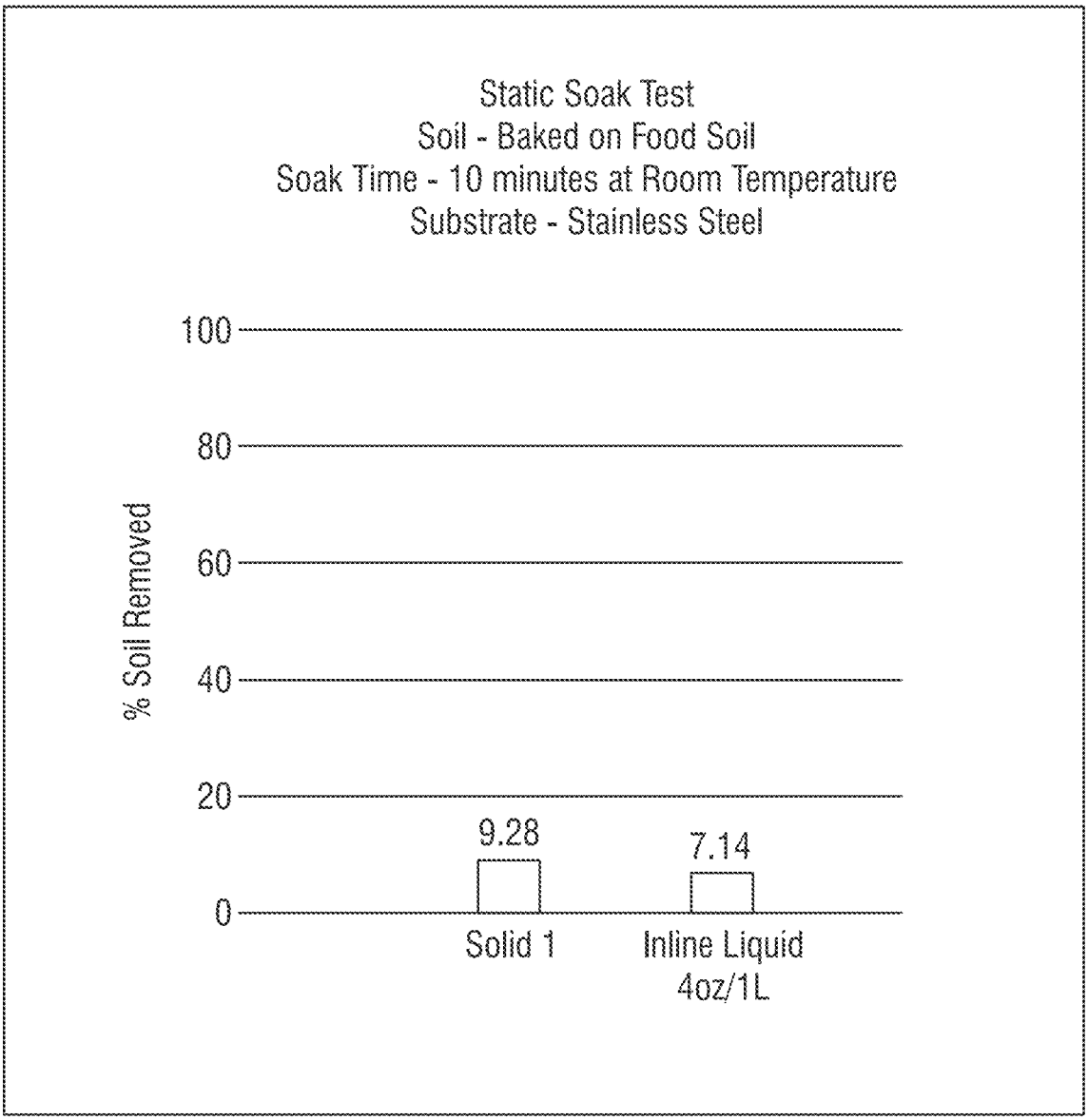
FIG. 5 shows a graph comparing red soil cleaning efficacy in a static soak test on baked on food soils of an evaluated solid hard surface cleaning composition compared to a liquid Control.

FIG. 5 shows the percentage of soil removal of Solid 1 composition compared to the liquid Control (again 6% use concentration of Solid 1 compared to a 4 oz/1 L dilution of the inline liquid Control, which provides 10-11% use concentration). The Solid 1 composition removed a slightly greater amount of baked on food soil (soils cooked in an over instead of drying overnight as outlined in Example 1) from stainless steel panels after a 10 minute soak at room temperature compared to the liquid Control. These results show at least equivalent performance at a lower concentration in the use solution of the solid 1 formulation compared to the inline liquid Control.

Example 4

Foam Test

Exemplary solid multi-surface cleaner compositions were prepared as a pressed solid tablet. Thereafter, a 6% dilution of the Solid 1 formulation of Table 2 providing approximately 1.2% surfactant concentration with 17 grain hard water was generated (which is an exemplary dilution for an intended application of use). In addition, a 10-11% use dilution of the liquid Control of Table 3 providing approximately 0.14% surfactant with 17 grain hard water was generated (this is based on the dilution recommended for the commercial product). The solutions were each sprayed onto a surface using a pump-up foamer dispenser to assess the generation of foam to allow enhanced contact time on the surface being treated with the hard surface cleaner.

The Solid 1 formulation using a pump up foamer provided thick, dense, creamy foam, which was dispensed in a stream and exhibited desirable cling to the vertical stainless steel panel surface. This demonstrates that a stable foam was obtained in comparison to the liquid Control. In contrast the liquid Control did not generate a foam and instead the liquid did not cling to the surface as there was very small amount of foam. This beneficially demonstrates the solid formulations described herein also provide enhanced foaming at lower concentrations than inline liquid Controls.

The 6% dilution of the Solid 1 formulation provides about a ten times greater concentration of surfactant compared to the Control even at a 10-11% use dilution of the liquid Control. The Solid 1 formulation also provides a greater concentration of alkalinity compared to the liquid Control. The benefit of providing the solid composition is the highly concentrated formulation that does not reach the solubility limits of a concentrated liquid formulation (such as with the alkalinity source and surfactants in the Control).

Example 5

Corrosion Testing & Stability

Variations of Solid 3 formulation set forth in Table 2 (with varying corrosion inhibitors substituted for the Sodium metasilicate anhydrous) were evaluated for soft metal protection. The variations of the formulation and results are show in Table 4. Exemplary solid multi-surface cleaner compositions were prepared as a pressed solid tablet.

TABLE 4

| Corrosion Inhibitor (CI) | Concentration CI at use dilution | Steel Panels 1020 Alloy Average Miles Per Year | Aluminum Panels 7075-T6 Allow Average Miles Per Year |
|---|---|---|---|
| No inhibitor—Control | 0 | 1.56 | 2742.7 |
| Sodium gluconate | 800 ppm | 1.13 | 2801 |
| Sodium silicate | 800 ppm | 0 | 7.4 |
| Sodium metasilicate anhydrous | 800 ppm | 0 | 2.5 |
| Sodium metasilicate pentahydrate | 800 ppm | 1.13 | 43.5 |

The test conditions were a 6 hour test at elevated water bath temperature of 113° F.+/−1.8° F. (45° C.+/−1.0° C.) where the Solid 3 formulations with varying corrosion inhibitors were used to soak stainless steel and aluminum panels to measure the amount of weight loss of the panels, as calculated in average miles per year lost. A threshold of less than 25 miles per year is required for commercially-acceptable corrosion inhibition. This is calculated based on MPY(milses/year) corrosion=wt·loss(mg)*534/Panel area*time(hrs)*metal density, wherein Density of steel=7.86 g/cm$^3$, Density of Aluminum=2.71 g/cm$^3$.

As shown in Table 4, the sodium silicate and sodium metasilicate anhydrous are suitable for use in protecting the softer aluminum metal (and also the stainless steel).

The stability of the various Solid 3 formulations evaluated in Table 4 were also analyzed for tablet stability through measurement of the dimensional stability. As referred to herein, dimensional stability refers to a change in dimension of a solid tablet. For the testing of the Solid 3 formulations the tablet width was measured as the indicator of change in dimension for the dimensional stability. The width of the table is critical as the solid formulations (in varying sizes) are meant for dispensing into use solution via a multi-use solid composition. Any significant changes in the width of the solid, here the evaluated tablets, will result in the solids not fitting into the dispensers (when there has been an increase in width due to a lack of dimensional stability). The testing requires a less than a 3% change in width (i.e. dimension) over the 8 weeks of testing to meet the dimensional stability requirements. The testing is conducted over 8 weeks at 40° C. in a humidity controlled chamber having a relative humidity of 65%. The width of the compositions were measured at 1 day, 2 days, 3 days, 5 days, 2 weeks, 3 weeks, and 8 weeks. The percent change in width were calculated to determine the amount of swelling in the compositions. Compositions having a growth of less than three percent are considered to be dimensionally stable.

Figure 6:
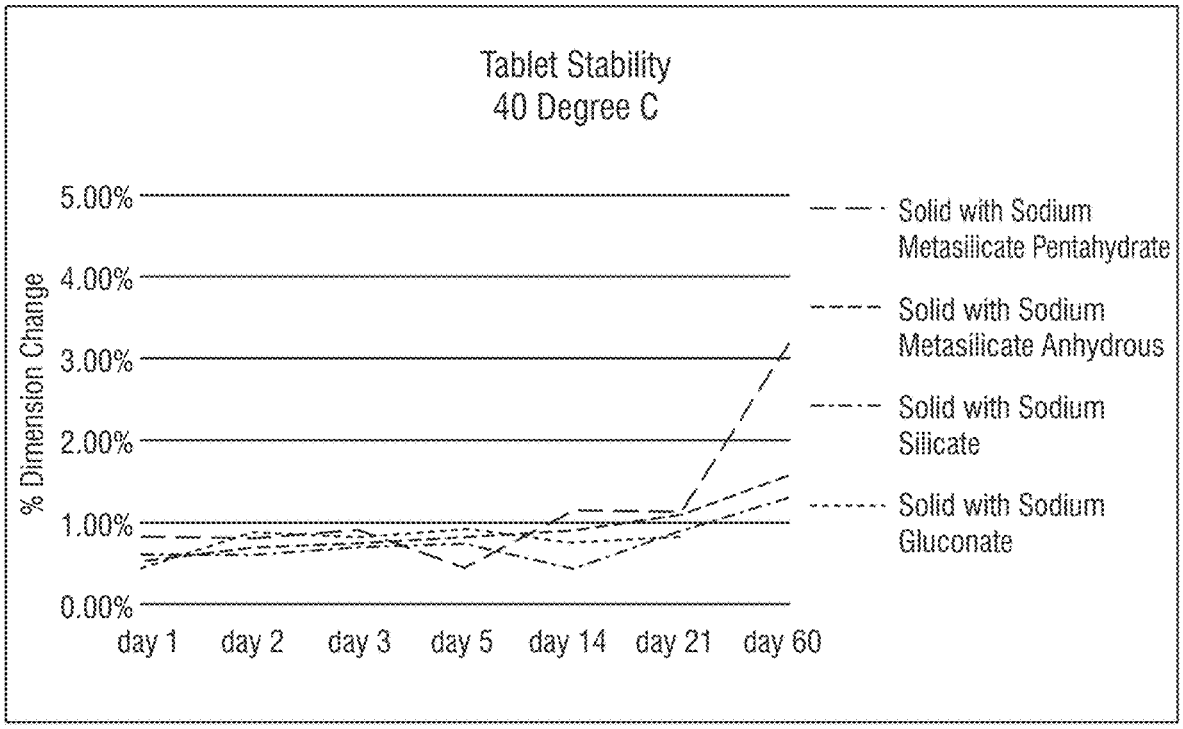
FIG. 6 shows a graph of tablet stability as measured by a percentage change in dimension of various pressed solid tablets containing varying corrosion inhibitors.

As shown in FIG. 6 the testing over 8 weeks could not be completed for the sodium gluconate. The solid formulation became too wet; in addition the sodium gluconate did not provide adequate metal protection as shown in Table 4. The sodium metasilicate pentahydrate approached and exceeded the dimensional stability threshold. The Solid 3 formulations with sodium metasilicate anhydrous and sodium silicate provided a dimensionally stable solid tablet over the 8 week period.

Example 6

Ready to Use Solution Stability Test

Exemplary solid multi-surface cleaner compositions were prepared as a pressed solid. The ready-to-use (6% concentration in 17 grain water) concentration of Solid 1 formulation was evaluated for initial stability and again at 4 weeks stability. The results are shown in Table 5.

TABLE 5

| Condition | | Initial Stability RTU of Solid—6% in 17grain water | 4 Weeks Stability RTU of Solid—6% in 17grain water |
|---|---|---|---|
| Fridge | pH | 10.96 | 10.98 |
| | Appearance/phase stability | Clear colorless | Clear colorless, no precipitate |
| Room Temperature | pH | 10.96 | 10.95 |
| | Appearance/phase stability | Clear colorless with no precipitate | Clear colorless with no precipitate |
| 40-degree C. | pH | 10.96 | 10.93 |
| | Appearance/phase stability | Clear colorless with no precipitate | Clear colorless with no precipitate |
| 50-degree C. | pH | 10.96 | 10.97 |
| | Appearance/phase stability | Clear colorless with no precipitate | Clear colorless with no precipitate |

The results of Table 5 show that across all temperature conditions, including the higher temperature conditions of 50° C. for 4 weeks (which is predictive of at least one year of shelf-stability at room temperature) the Solid formulations provide stable use solutions.

Example 7

Additional Testing of the Formula 3 of the Solid Formulations Set Forth in Table 2 in Comparison to the Liquid Control Set Forth in Table 3 was Evaluated in Field Trial Locations to Assess Qualitative Efficacy.

The first testing location was an outdoor concrete surface in front of trash dumpsters at a drive-thru restaurant location. The ground surface was contacted with a 6% solution of Formula 3 next to a location tested with the Control at a 50% dilution. The two solutions were applied to the surface, scrubbed and then rinsed. Visual assessment indicated that the cleaning results of the solid cleaning composition were at least equal to or improved in comparison to the control benchmark. It is notable that concrete is extremely porous and the location tested was heavily soiled with motor oil, which is a very tenacious soil, making this combination very difficult to clean. The results indicate that the solid cleaning compositions provide a suitable alternative for cleaning such a hard surface.

The second testing location was inside a commercial fast food restaurant on equipment used in frying foods. One side of the stainless steel surface was sprayed with a 6% solution of Formula 3 and the other side was sprayed with the Control at a 1:9 dilution. The two solutions were sprayed onto the surface, allowed to dwell for 1 minute, then wiped from the surface, rinsed, and allowed to dry at ambient temperature. Visual assessment indicated that the cleaning results of the solid cleaning composition were improved in comparison to the control benchmark, indicating that the solid cleaning compositions provide a suitable alternative for cleaning such a hard surface and removing the difficult polymerized soils.

The third testing location was inside a commercial fast food restaurant on a front surface of a fryer soiled with greasy soils. One side of the stainless steel surface was sprayed with a 6% solution of Formula 3 and the other side was sprayed with the Control at a 1:9 dilution. The two solutions were sprayed onto the surface, allowed to dwell for 1 minute, then wiped from the surface, rinsed, and allowed to dry at ambient temperature. Visual assessment indicated that the cleaning results of the solid cleaning composition were improved in comparison to the control benchmark, indicating that the solid cleaning compositions provide a suitable alternative for cleaning such a hard surface.

The inventions being thus described, it will be obvious that the same may be varied in many ways. Such variations are not to be regarded as a departure from the spirit and scope of the inventions and all such modifications are intended to be included within the scope of the following claims. The above specification provides a description of the manufacture and use of the disclosed compositions and methods. Since many embodiments can be made without departing from the spirit and scope of the invention, the invention resides in the claims.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. A solid cleaning composition comprising:

(a) from about 50 wt-% to about 60 wt-% of an alkali metal carbonate alkalinity source;

(b) from about 10 wt-% to about 20 wt-% of an aminocarboxylic acid comprising one or more of methylglycinediacetic acid, N-hydroxyethyliminodiacetic acid, nitrilotriacetic acid, ethylenediaminetetraacetic acid, N-hydroxyethyl-ethylenediaminetriacetic acid, diethylenetriaminepentaacetic acid, ethylenediaminetetraproprionic acid, or triethylenetetraamine-hexaacetic acid; and a water-soluble polycarboxylate polymer;

(c) from about 5 wt-% to about 15 wt-% of an amphoteric surfactant;

(d) from about 10 wt-% to about 30 wt-% of an anionic surfactant, wherein the anionic surfactant comprises a sulfate, sulfonate, phosphate, and/or carboxylate, and wherein the anionic surfactant does not comprise linear alkyl benzene sulfonate; and (e) from about 1 wt-% to about 5 wt-% of a corrosion inhibitor comprising sodium silicate and/or sodium metasilicate anhydrous;

wherein the composition is a multi-use pressed solid and does not comprise hydroxide alkalinity sources, and wherein a liquid use composition has a pH of less than about 11 and is a stable liquid for up to about 1 year at room temperature.

2. The composition of claim 1, wherein the water-soluble polycarboxylate polymer is a homopolymer of acrylic acid.

3. The composition of claim 1, wherein the amphoteric surfactant comprises an amine oxide and/or a betaine.

4. The composition of claim 1, wherein the amphoteric surfactant and the anionic surfactant comprise at least about 20 wt-% of the solid cleaning composition.

5. The composition of claim 1, wherein the solid composition has dimensional stability measured by a growth exponent of less than 3% for at least 8 weeks at 40° C.

6. The composition of claim 1, wherein the liquid use composition is a stable liquid for up to about 6 months at room temperature.

7. A solid cleaning composition consisting essentially of:

(a) from about 50 wt-% to about 60 wt-% of an alkali metal carbonate alkalinity source;

(b) from about 10 wt-% to about 20 wt-% of at least two chelants comprising an aminocarboxylic acid comprising one or more of methylglycinediacetic acid, N-hydroxyethyliminodiacetic acid, nitrilotriacetic acid, ethylenediaminetetraacetic acid, N-hydroxyethyl-ethylenediaminetriacetic acid, diethylenetriaminepentaacetic acid, ethylenediaminetetraproprionic acid, or triethylenetetraamine-hexaacetic acid; and a water-soluble polycarboxylate polymer;

(c) from about 5 wt-% to about 15 wt-% of an amine oxide amphoteric surfactant;

(d) from about 10 wt-% to about 30 wt-% of a sulfate or sulfonate anionic surfactant, wherein the anionic surfactant does not include linear alkyl benzene sulfonate; and (e) from about 1 wt-% to about 5 wt-% of a corrosion inhibitor comprising sodium silicate and/or sodium metasilicate anhydrous;

wherein the composition is a multi-use pressed solid and does not comprise hydroxide alkalinity sources, and wherein a liquid use composition has a pH of less than about 11 and is a stable liquid for up to about 6 months at room temperature.

8. The composition of claim 7, wherein the water-soluble polycarboxylate polymer comprises a homopolymer of acrylic acid.

9. A method of cleaning a hard surface comprising:

providing the cleaning composition of claim 1 to a hard surface in need of cleaning, wherein the cleaning composition provides a higher concentration of surfactants and/or alkalinity in comparison to a liquid concentrated cleaning composition.

10. The method of claim 9, further comprising a step of contacting the cleaning composition with water to generate a use solution and thereafter contacting the use solution to the hard surface in need of cleaning.

11. The method of claim 9, where the hard surface is a food preparation surface, a surface in a restaurant, a surface in a grocery store, a household surface, a floor, a drive-thru surface, and/or wherein the hard surface comprises food soils.

12. The method of claim 9, wherein the hard surface is metal.

* * * * *